United States Patent [19]

Goto et al.

[11] 4,347,077

[45] Aug. 31, 1982

[54] PROCESS FOR PRODUCING MAGNESIUM ALLOYS

[75] Inventors: Takeshi Goto, Atsugi; Noboru Kawakami, Tokyo; Itsuo Hirano, Sagamihara; Yoichi Itakura, Musashino; Yuji Kawahara, Chigasaki, all of Japan

[73] Assignee: Toyo Soda Manufacturing Co., Ltd., Yamaguchi, Japan

[21] Appl. No.: 206,298

[22] Filed: Nov. 12, 1980

[30] Foreign Application Priority Data

Nov. 19, 1979 [JP] Japan ..... 54-148993

[51] Int. Cl.[3] ..... C22C 23/00; C22C 1/00

[52] U.S. Cl. ..... 75/0.5 B; 75/67 R; 75/129; 75/134 S; 75/147; 75/153; 75/168 R; 75/168 B; 75/168 F; 75/170

[58] Field of Search ..... 75/0.5 B, 168 R, 168 B, 75/168 C, 168 D, 168 E, 168 F, 168 G, 168 H, 168 J, 168 K, 168 L, 168 M, 67 R, 67 A, 58, 130 A, 252, 147, 170, 153, 134 S, 129; 148/11.5 P

[56] References Cited

U.S. PATENT DOCUMENTS

| | | | |
|---|---|---|---|
| 2,238,907 | 4/1941 | McConica et al. | 75/67 R |
| 3,219,490 | 11/1965 | Foerster et al. | 148/11.5 P |
| 3,505,063 | 4/1970 | Schmidt | 75/67 |

*Primary Examiner*—M. J. Andrews

*Attorney, Agent, or Firm*—Cushman, Darby & Cushman

[57] ABSTRACT

Process for producing a magnesium alloy which comprises:

reducing magnesium oxide with a carbonaceous substance at high temperatures;

rapidly cooling the resultant reaction product in an inert atmosphere to obtain powder magnesium;

mixing the reaction product with a powder metal to be alloyed therewith during or after the rapid cooling; and subjecting the mixture to heat treatment.

7 Claims, 3 Drawing Figures

PROCESS FOR PRODUCING MAGNESIUM ALLOYS

BACKGROUND OF THE INVENTION

It has been generally established that magnesium (hereinafter abridged as Mg) is an element which can markedly improve mechanical properties of aluminum-base alloys (hereinafter called Al-base alloys), and normally 0.5 to 5.5% by weight Mg is contained in Al-base alloys. It has been also well known that Mg-Al alloys just as Fe-Si-Mg, Ni-Mg, Cu-Mg and Ca-Si-Mg alloys are widely used as a purifying additive such as for deoxidation, desulfurization and dephosphorization of steel or non-ferrous alloys, and also used as a graphite spheroidizing agent for cast iron.

Also magnesium alloys for casting, die casting and extrusion contain Al, Zn, Mn and Si.

For production of Mg-containing alloys and Al-based or Mg-based alloys which are used as a metallurgical alloying additive, Al-Mg alloy, Al-Mn-Mg alloy, Al-Zn-Mg alloy or Al-Si-Mg alloy is used for addition of elements other than Al or Mg, and these intermediate alloys are used for the purpose of improving the reaction rate of Mg or dissolution yield of Mg. The use of these intermediate alloys provide technical advantages such that the chemical property of Mg, namely the explosive vapourization of Mg can be effectively prevented, that the melting point of Mg can be favourably lowered so that the dissolution rate of Mg in the molten metal can be increased, and that the yield of alloying elements can be increased. Further, Mg in the form of alloys with other element or elements has advantages that not only the deterioration of Mg quality during transportation and storage can be effectively prevented, but also safety can be assured.

The most common conventional art for production of magnesium alloys as mentioned above comprises maintaining elements other than Mg at a temperature high enough to melt the alloys to be obtained (about 700° C. for Al-Mg alloy, and about 1400° C. for Fe-Si-Mg alloy) quickly immersing a predetermined amount of Mg in the lump form in the molten heat with consideration taken to the possible loss of Mg by oxidation or vapourization by means of a plunge to fully dissolve Mg therein, pouring the heat into a mold, cooling and solidifying the heat, and if necessary, crushing the solidified alloy into lumps or granules.

The above conventional art not only has economical disadvantages that the loss of Mg during melting and crushing is considerable, but also is dangerous, and undesirable from the aspect of hygiene, and also troublesome.

SUMMARY OF THE INVENTION

One of the objects of the present invention is to provide a process for producing magnesium alloys free from the various disadvantages and problems, mainly with respect to the yield of Mg and the operational safety, of the conventional art.

The present inventors have conducted extensive studies and experiments on production of magnesium alloys.

The process according to the present invention comprises mixing powder magnesium obtained under a certain condition with powders of other element or elements (or alloy), forming the mixture into granules, pellets or bricks, heating the formed mixture and maintaining it at a predetermined temperature for a predetermined period of time.

The present invention has technical and economical advantages that the treating temperature required for production of the alloys is low and the process itself is simple and safe, and that the yield of Mg is high.

What is more advantageous is that as the powder magnesium used in the present invention is super fine as several $\mu$ or finer, the mixing with other metal powders is very satisfactory so that the segregation of metal components as often encounted in the powder metallurgy is very rare in the present invention and a homogeneous alloy can be obtained by short-time treatment.

DETAILED DESCRIPTION OF THE INVENTION

Figure 1A:
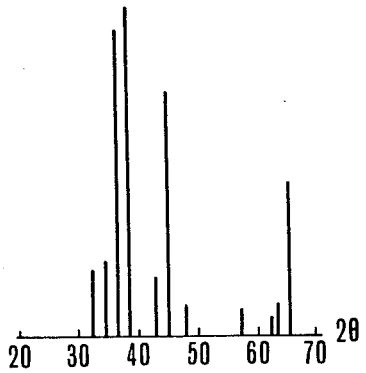
FIGS. 1 to 3 schematically show X-ray diffraction charts before and after the heat treatment of the alloys obtained according to Examples 1 to 3.

The present invention will be described in more details.

The powder magnesium used in the present invention is metallic magnesium obtained by reducing magnesium oxide (MgO) with carbon at high temperatures (1000° C. or higher).

The above reaction, $MgO+C=Mg+CO$, is reversible within a certain temperature range. Therefore, in order to recover Mg with high yield from the reaction product (Mg, CO) obtained by reduction with carbon at a high temperature not lower than 1000° C., it is necessary to cool the reaction product as quickly as possible (usually 1/100–1/1000 second) to a temperature not higher than 400° C., preferably 200° C., so as to avoid the reverse reaction. Various methods may be considered for the cooling and the most desirable one is to bring the reaction product into contact with a large amount of inert gas ($H_2$, Ar, $N_2$ and natural gas, such as $CH_4$). The amount of the cooling gas should be at least 10 times, preferably 20 to 60 times larger than the gaseous reaction product.

The metallic magnesium obtained by the rapid cooling is very fine powder having an average particle size of about 1$\mu$, and thus very favourable for obtaining a homogeneous alloy composition by the alloying step.

As for the method for mixing the metallic powder magnesium with other element or elements, a mechanical mixing method may be employed by which predetermined proportions of the magnesium powder and the other element or elements are mixed by a general mixer under presence of inert gas, such as Ar, He, $N_2$ and $H_2$. However, it is more preferable that the cooling gas for rapid cooling of the reduction product of MgO for production of the metallic magnesium is accompanied with the other element or elements in an amount enough to obtain a predetermined alloy composition, or the other element or elements is introduced to the rapid cooling section from portions other than the cooling gas introducing hole so as to effect the mixing simultaneously with the formation of the magnesium powder.

In this case, when Mg sublimates from the gaseous phase to the solid phase in the powder form, Mg sublimates around the other metal powders introduced into the reducing reaction vessel (the cooling section), so that the homogeneity of the alloy composition is further improved and the heat treatment can be performed in a shorter time.

The alloy powders mixed with the above methods can be, directly or after packed in a metal case, used satisfactorily as a magnesium alloy for addition of magnesium, but it is preferable to form the alloy powders into shapes such as granules, pellets or lumps and subject these shapes to heat treatment at a predetermined temperature and under a predetermined pressure. The mixing and forming should be done in an atmosphere of inert gas such as He, Ar, $H_2$ and $N_2$, which are inert to the magnesium powders at ordinary temperatures, and the heat treatment also should be performed in an atmosphere of inert gas, such as $H_2$ and Ar.

In the case of alloys which require higher treatment temperatures, He or Ar gas should be sealed in the heating system so as to maintain the heating system at a pressure not lower than the atmospheric pressure.

Regarding the conditions for heat treatment of various alloys, it is preferable that the temperature is within a temperature range from 200° C. below the melting point of a desired alloy to 200° C. higher than the melting point, and that the pressure in the heating system is higher than the atmospheric pressure when the temperature is higher than 700° C. because of the increased loss by vapourization (for example 0.4 kg/cm$^2$G at 900° C. and 1.5 kg/cm$^2$G at 1100° C.), while the atmospheric pressure is enough when the temperature is lower than 700° C. However, in the case of elements, such as in the case of Mg-Zn alloy, which have a higher vapour pressure than Mg, the heat treatment should be preferably performed under a pressure higher than the atmospheric pressure when the temperature is 500° C. or higher.

According to the present invention, almost all of the conventional magnesium alloys containing, for example 0.5 to 99.5% magnesium, can be satisfactory produced, and as for the element to be mixed with the powder magnesium, Al, Zn, Cu, Ni, Fe, Si and so on may be used in single or in combination.

DESCRIPTION OF PREFERRED EMBODIMENTS

The present invention will be better understood from the following embodiments.

EXAMPLE 1

The powder magnesium used in this example was prepared by mixing magnesia clinker with oil coke in a stoichiometrical equivalence together with polyvinyl alcohol as binding agent, and granulating the mixture into granules (2 mm×1 mm), drying the granules at about 300° C. to obtain the starting material.

This starting material was supplied into a reaction chamber (carbon crucible) maintained at 1850° C. at a supply rate of about 2.4 g/min.

At the relatively upper portion of the reaction chamber, the reaction gas (Mg, CO) thus produced was brought into contact with argon gas introduced (35 Nl/min) into the chamber through a cooling gas blowing nozzles provided on the opposing walls at the inlet of a cooling chamber annexed to the reaction chamber, and introduced into the cooling chamber where the gas was cooled into magnesium dust.

The magnesium dust thus collected has the composition of

Mg: 88.8 wt.%
C: 3 wt.%

500 g of the magnesium (about 1μ in diameter) was mixed with 980 g of powder aluminum (under 325 Tyler mesh), and the mixture was formed into pellets of 30 mm in diameter and 15 mm in height in an argon gas atmosphere with a forming pressure of 0.5 t/cm$^2$.

The pellets thus obtained were held for 3 hours in an argon gas furnace (Ar: normal atmospheric pressure) at 600° C. to obtain Al-Mg mother alloy. The alloy was cooled to room temperature and subjected to X-ray diffraction. The results identifies the alloy to be $Al_3Mg_2$.

Also the results of chemical analyses of the alloy show the magnesium content in the alloy ranges from 29.4 to 30.3%, and tests (plunger type) for melting the alloy into molten aluminum show that the alloys according to the present invention have a higher dissolution ratio and also a higher dissolution yield as compared with metallic magnesium used as comparison.

The dissolving tests were done under the following conditions.

Al heat: 0.9 kg (in an iron crucible of 80 mm in inside diameter)
Temperature: 700° C.
Atmosphere: The surface of heat was protected by Ar gas (10 l/min.)
Addition of Mg: Immersion by means of a plunger.

The results of the tests are shown below.

| | Mg-addition agent | Amount added | Mg concentration after melting | Dissolution yield of Mg |
|---|---|---|---|---|
| Present Alloy | Al—Mg (29.9% Mg) | 100 g | 2.7 | 90 |
| Comparison | Mg metal (99.8% Mg) | 30 g | 2.4 | 75 |

Figure 1B:
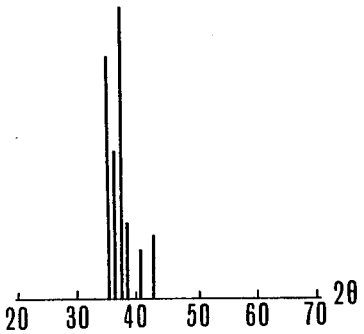

The X-ray diffraction charts (Cu-Kα) of the resultant alloys before and after the heat treatment are schematically shown in FIG. 1.

EXAMPLE 2

Lightly burnt magnesia, oil coke, and coal tar pitch were mixed together (molar ratio of C/MgO=1.08/1) and the mixture was heated to about 100° C., mixed, and immediately granulated into granules of about 1 mm by means of a conventional pelletizer. These granules were further fired at a temperature not lower than 400° C. to remove the volatile matters contained in the pitch by vapourization, thus obtaining strong starting material due to the carburization reaction with the pitch.

The starting material thus obtained was supplied to the reaction chamber (same as in Example 1) maintained at about 1800° C. at a supply rate of about 1.5 g/min. Nitrogen gas (35 Nl/min.) was used for rapid cooling, and this gas was accompanied with powder ferro-silicon (JIS No. 2: under 100 mesh) at a velocity of 1.08 g/min. the magnesium gas resultant from the reaction was rapidly cooled simultaneously with mixing with the powder ferro-silicon.

The mixed powders have the following composition (wt.%).

| Mg | Si | C | N |
|---|---|---|---|
| 30.7 | 44.2 | 3.0 | 0.2 |

The mixed powders were formed into pellets of 30 mm in diameter and 15 mm in height in an argon gas atmosphere, and then subjected to a heat treatment (1100° C. for 20 min. Ar: 5 kg/cm$^2$G).

Figure 2A:
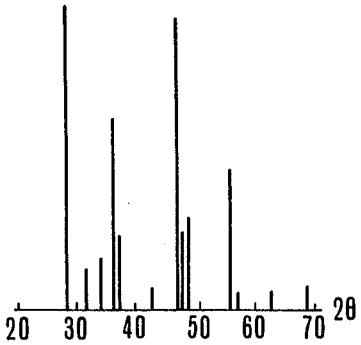
Figure 2B:
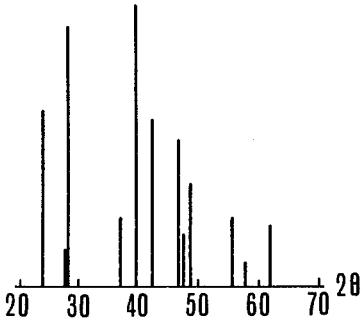

The pellets after the heat treatment were identified by X-ray diffraction to be $Mg_2Si$. The X-ray diffraction charts are schematically shown in FIG. 2.

EXAMPLE 3

500 g of the magnesium dust having the same composition as in Example 1 was mixed with 200 g of powder nickel (under 100 mesh) in an argon atmosphere, formed into pellets under the same conditions as in Example 1, and subjected to heat treatment at 800° C. for one hour (Ar: 1 kg/cm$^2$G).

The pellets after the heat treatment were identified by X-ray diffraction to be $Mg_2Ni$.

Figure 3A:
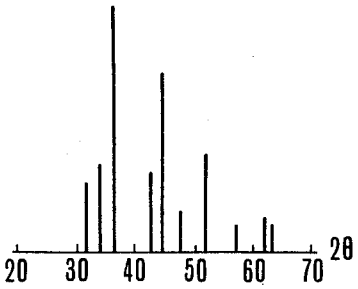
Figure 3B:
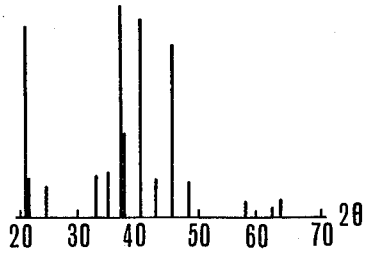

The X-ray diffraction charts are schematically shown in FIG. 3.

What is claimed is:

1. Process for producing a magnesium alloy which comprises the steps of:

(a) reducing magnesium oxide with a carbonaceous substance at high temperature to form a gaseous reaction product comprising gaseous magnesium, (b) rapidly gas cooling said gaseous reaction product with a cooling gas in an amount of at least 10 times the amount of said gaseous reaction product in an inert atmosphere containing metal powder of at least one of aluminum, copper, nickel, iron, silicon, or alloys thereof, (c) condensing the gaseous magnesium on the surface of said metal powder, and (d) subjecting the condensed product of step (c) to heat treatment.

2. Process according to claim 1 in which the reaction product is rapidly cooled to 400° C. or below.

3. Process according to claim 1 wherein the cooling gas is used in an amount 20 to 60 times the amount of the gaseous reaction product.

4. Process according to claim 1 in which the metal to be alloyed with the reaction product is mixed therewith before or during the rapid cooling.

5. Process according to claim 4 in which the reaction product to be alloyed with the powder metal is not larger than 10$\mu$.

6. Process according to claim 4 wherein the alloying metal is mixed with the magnesium before the rapid cooling.

7. Process according to claim 4 wherein the alloying metal is mixed with the magnesium during the rapid cooling.

* * * * *